US005860171A

United States Patent [19]

Hicks

[11] Patent Number: 5,860,171

[45] Date of Patent: Jan. 19, 1999

[54] SUSPENDED DETACHABLE SWIMMING POOL ACCESSORIES

[76] Inventor: Billy Gene Hicks, 330 Anniston Dr., Dayton, Ohio 45415

[21] Appl. No.: 781,073

[22] Filed: Jan. 9, 1997

[51] Int. Cl.[6] ..... E04H 4/14

[52] U.S. Cl. ..... 4/496

[58] Field of Search ..... 4/494, 496, 506, 4/578.1, 579

[56] References Cited

U.S. PATENT DOCUMENTS

| | | | |
|---|---|---|---|
| 2,052,628 | 9/1936 | Higgins | 4/579 |
| 2,328,235 | 8/1943 | Setzler | 4/578.1 |
| 4,837,869 | 6/1989 | Simmon | 4/496 |
| 4,893,363 | 1/1990 | Huff | 4/496 |
| 5,307,527 | 5/1994 | Schober | 4/496 |
| 5,333,322 | 8/1994 | Weir | 4/496 |

OTHER PUBLICATIONS

KDI Paragon Inc., "Quality Swimming Pool Equipment", 2 pts, 1977.

*Primary Examiner*—Robert M. Fetsuga
*Attorney, Agent, or Firm*—Biebel & French

[57] ABSTRACT

An apparatus suspending a detachable accessory adjacent a vertical wall defining a swimming pool is disclosed. The apparatus includes a pair of U-shaped arms having base ends fixed outside the swimming pool and cantilever ends supported inside the swimming pool below the base ends. A support bar is rotatably mounted between the arms and includes a plurality of mounting tubes within which a plurality of accessories are detachably mounted.

17 Claims, 6 Drawing Sheets

112
102
106
56
54
22
10'
100
110
78
84'
124
120
118
84'
12'
116
88'
122
108
104
114
24

SUSPENDED DETACHABLE SWIMMING POOL ACCESSORIES

BACKGROUND OF THE INVENTION

1. Field of the Invention

The present invention relates to recreational equipment and, more particularly, to an apparatus for suspending a plurality of detachable accessories adjacent a vertical wall defining an aquatic body, such as a swimming pool.

2. Description of the Prior Art

A swimming pool is a popular recreational feature of many homes and a wide variety of accessories are available to promote an individual's enjoyment of a swimming pool. One type of accessory is a floating chair which allows an individual to sit in the chair and float with his or her body partially submerged in water.

While such chairs have found widespread use, they have many inherent disadvantages. One disadvantage with prior art floating chairs is their tendency to float in a random manner. The individual within the chair may often wish to remain in a fixed location and orientation for a number of reasons, including, improving his or her suntan or socializing with others in the pool. Further, many individuals find floating chairs uncomfortable because of their bobbing movement in response to waves present in the pool water.

In response to the problems associated with floating chairs, chairs supported by the structure of the swimming pool have been proposed. While these structure supported chairs address many of the problems outlined above, they lack versatility in that additional swimming pool accessories may not be conveniently attached thereto. For example, it would be advantageous to have a table adjacent the chair upon which an individual could place items, such as refreshments, suntan oil and towels. Further, many individuals would appreciate an umbrella adjacent the chair for providing an area of shade. Additionally, it would be advantageous to have a baby seat adapted to support an infant which could be supported by the structure of the swimming pool.

Another limitation with prior art structure supported accessories is that they are not detachably mounted wherein an accessory, e.g. a chair, may not be interchanged with a different type of accessory, e.g. a table, an umbrella, a baby seat or a toy. Further, the prior art fails to disclose an apparatus for supporting a plurality of detachable, interchangeable, accessories adjacent a pool structure. Such a device would allow an individual to customize the arrangement of pool accessories to his or her satisfaction.

Accordingly, there is a need for an apparatus for suspending a detachable accessory adjacent a swimming pool structure. Further, there is a need for such an apparatus for suspending a plurality of detachable accessories wherein the arrangement of accessories may be customized by the user.

SUMMARY OF THE INVENTION

The present invention provides an apparatus suspending at least one detachable accessory adjacent a vertical wall defining an aquatic body. More particularly, the preferred embodiment of the present invention provides an apparatus for suspending a plurality of accessories adjacent a vertical wall defining a swimming pool, wherein the user may customize the arrangement of accessories.

The apparatus of the present invention includes a first arm adjacent a vertical wall defining a swimming pool. A second arm is located adjacent the vertical wall in spaced relation to the first arm. Both arms comprise U-shaped members having a base end and a cantilever end. The base ends are attached to a surface defining a deck outside the swimming pool while the cantilever ends are supported inside the swimming pool below the base ends.

A support bar extends between the first and second arms proximate the cantilever ends. The support bar includes a plurality of mounting tubes intermediate the first and second arms. The first and second arms together with the support bar define a frame.

A wall engaging structure includes a plurality of stop arms fixed to the support bar for engaging an inside surface of the vertical wall. Each stop arm includes a wall engaging end having a resilient stop member fixed thereto.

A plurality of swimming pool accessories are adapted to be detachably mounted to the support bar. The accessories may include any combination of chairs, tables, umbrellas, baby seats or toys thereby permitting the user to select his or her preference. Each accessory includes an attachment rod for detachably engaging one of the mounting tubes of the support bar wherein a wide variety of accessory combinations and placement options are available.

In an alternative embodiment, the apparatus comprises a single S-shaped arm having a base end and a cantilever end. A mounting tube is defined by the cantilever end for detachably engaging the attachment rod of an accessory.

Therefore, it is a general object of the present invention to provide an apparatus suspending an accessory adjacent a vertical wall defining an aquatic body.

It is another object of the invention to provide such an apparatus having adjustable base ends for securing to a deck outside an aquatic body.

It is an additional object of the invention to provide such an apparatus wherein the accessory is detachably mounted thereby permitting the accessory to be interchanged with a different accessory.

It is a further object of the invention to provide such an apparatus wherein a plurality of accessories are detachably mounted thereby permitting the user to customize the arrangement of accessories.

It is another object of the invention to provide such an apparatus wherein the accessories may comprise any combination of chairs, tables, umbrellas, baby seats or toys.

It is yet a further object of the invention to provide a detachable chair supported by such an apparatus wherein a user is partially submerged in pool water and remains in a stationary position.

It is a further object of the invention to provide a detachable table supported by such an apparatus upon which a user may conveniently place objects.

Other objects and advantages of the invention will be apparent from the following description, the accompanying drawings and the appended claims.

DETAILED DESCRIPTION OF THE PREFERRED EMBODIMENT

Figure 1:
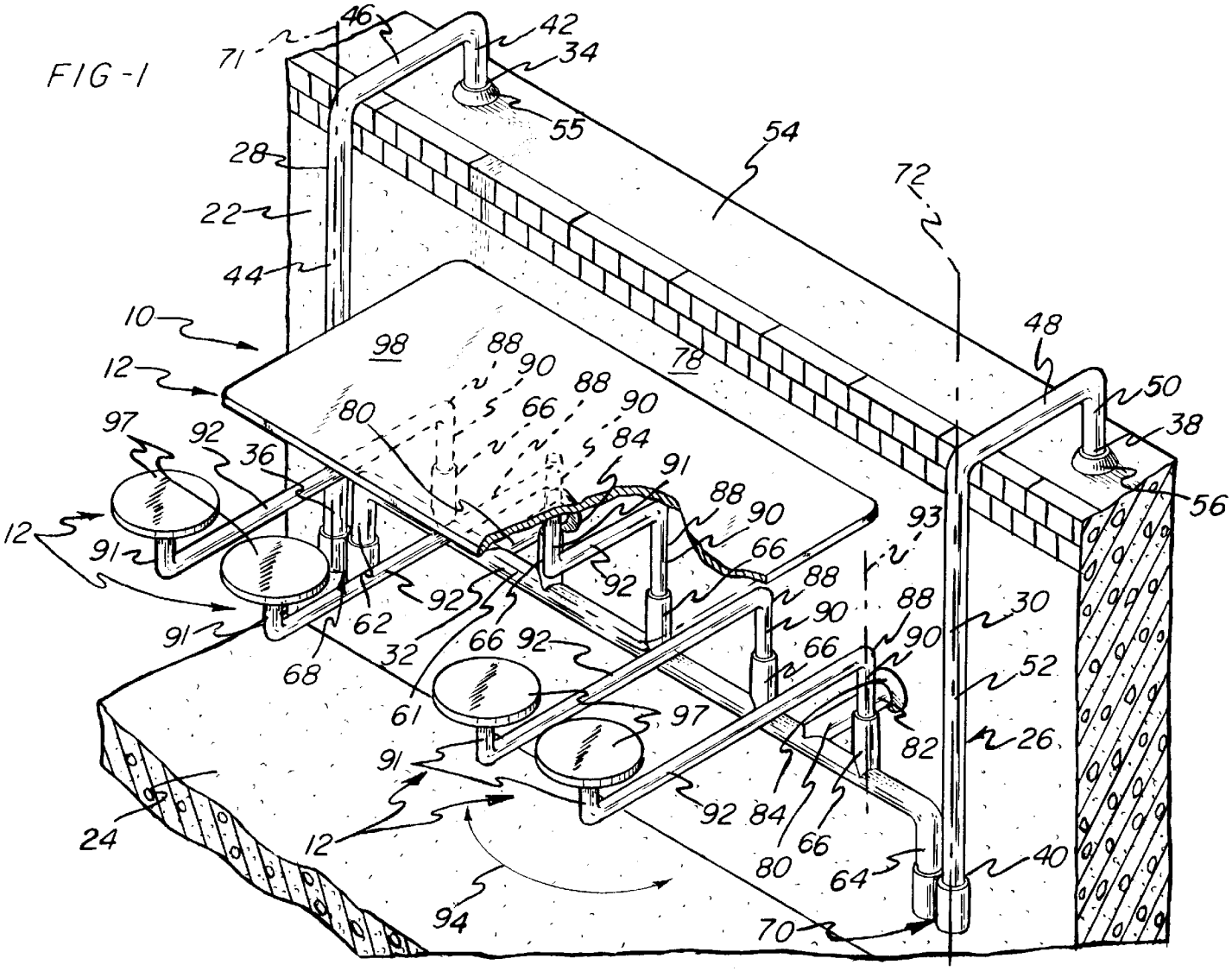
FIG. 1 is a perspective view with a partial cut-away of the preferred embodiment of the present invention supported by a vertical wall defining a swimming pool.
Figure 2:
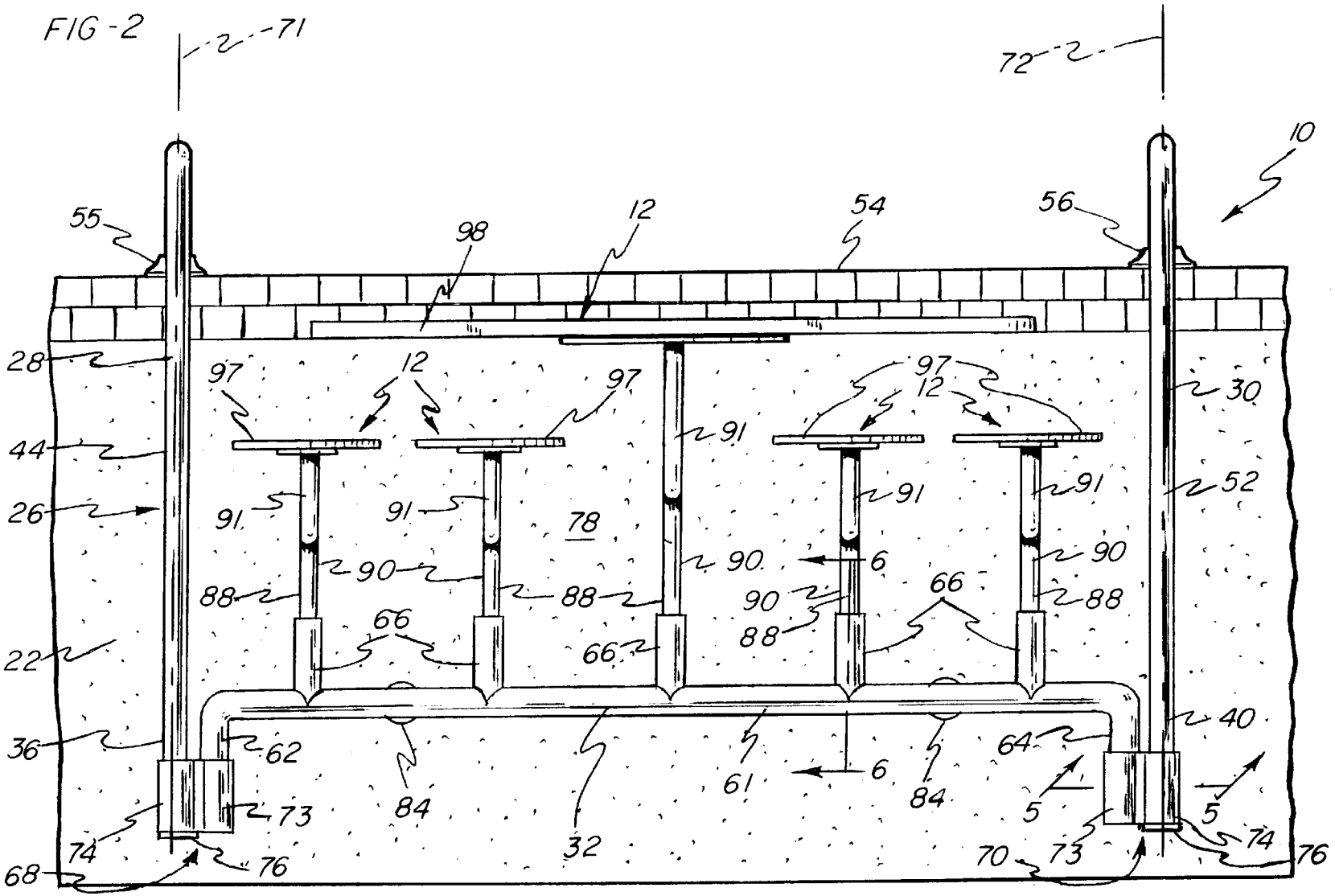
FIG. 2 is a front view thereof.
Figure 3:
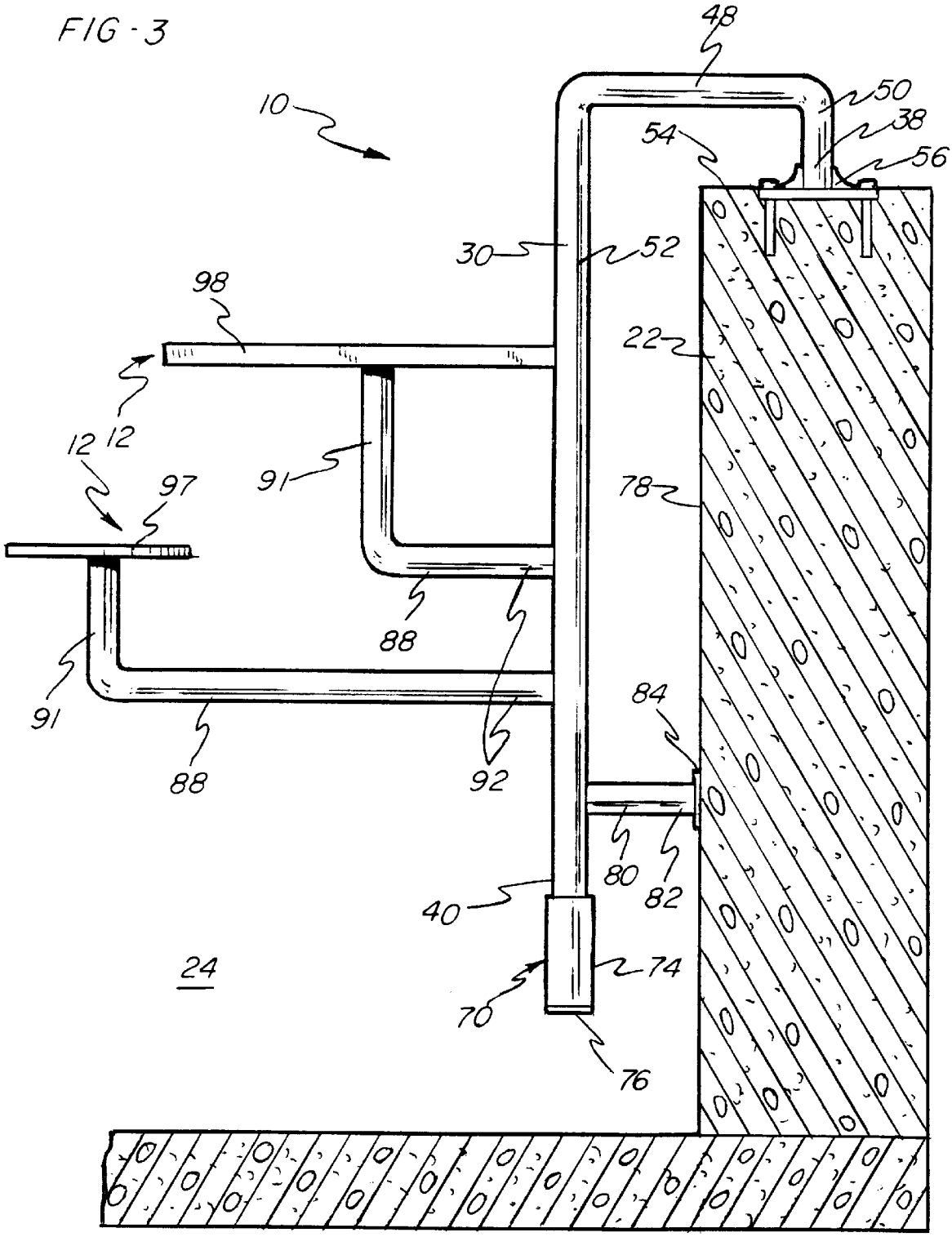
FIG. 3 is a side view thereof.

Referring initially to FIGS. 1–3, the preferred embodiment of the present invention provides an apparatus 10 suspending a plurality of accessories 12, adjacent a vertical wall 22 defining a swimming pool 24. The apparatus 10 includes a frame 26 which is defined by a first arm 28, a second arm 30 and a support bar 32 extending therebetween.

The first arm 28 is located adjacent the vertical wall 22 and includes a base end 34 and a cantilever end 36. Similarly, the second arm 30 is located adjacent the vertical wall 22, in spaced relation to the first arm 28, and includes a base end 38 and a cantilever end 40.

Both first and second arms 28 and 30 comprise U-shaped members wherein the first arm 28 includes a first substantially vertical portion 42 connected to a second substantially vertical portion 44 by a substantially horizontal portion 46. The second arm 30 is of similar design in that a substantially horizontal portion 48 connects first and second substantially vertical portions 50 and 52.

The first and second arms 28 and 30 are attached to a surface defining a deck 54 outside the swimming pool 24. In the preferred embodiment, the base ends 34 and 38 are received within anchor sockets 55 and 56 formed in the deck 54. The base ends 34 and 38 are secured by bolts (not shown) extending through the anchor sockets 55 and 56 in a manner as is well known in the art.

The U-shaped structure of the first and second arms 28 and 30 allows them to straddle the vertical wall 22 as shown in FIGS. 1 and 2 wherein the base ends 34 and 38 are outside the swimming pool 24 while the cantilever ends 36 and 40 are supported inside the swimming pool 24. The first substantially vertical portions 42 and 50 are significantly shorter than the corresponding second substantially vertical portion 44 and 52 of each arm 28 and 30 such that the cantilever ends 36 and 40 are below the base ends 34 and 38. The first and second arms 28 and 30 are dimensioned in such a manner providing for the cantilever ends 36 and 40 to be submerged in water.

Figure 4:
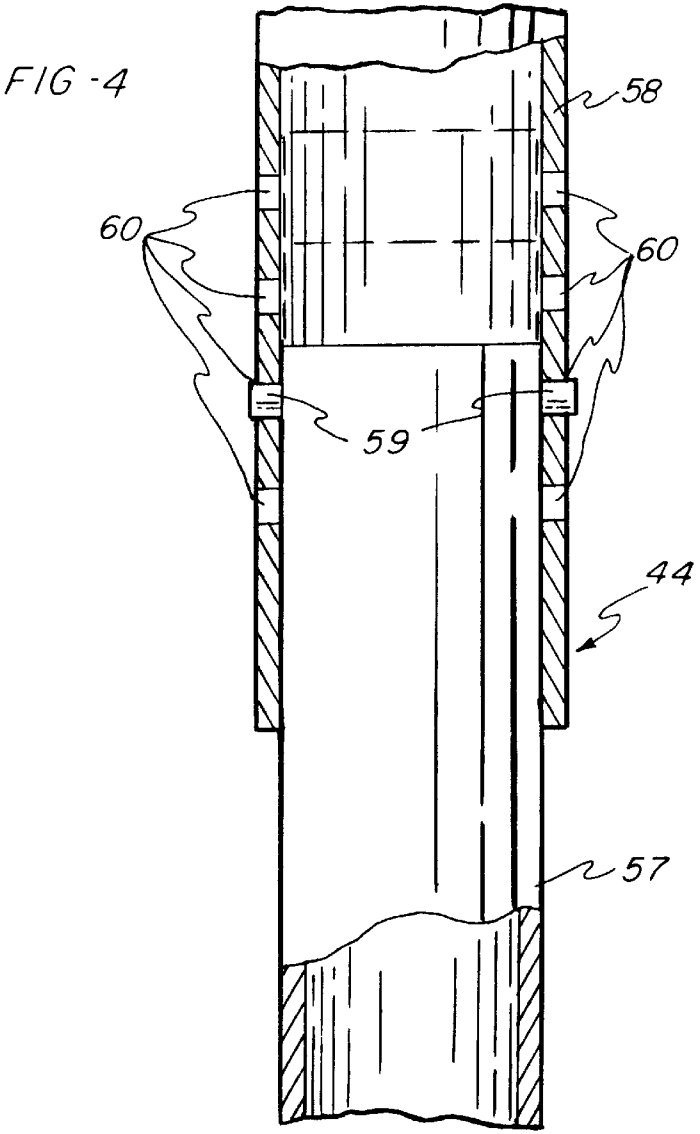
FIG. 4 is a partial cross-sectional view of an alternative embodiment of the first arm of the present invention.

Referring to FIGS. 1 and 4, the second substantially vertical portion 44 may include an inner tube 57 received within an outer tube 58 in a telescoping relationship for adjusting the vertical position of the cantilever end 36. The inner tube 57 may include a pair of spring biased pins 59 adapted to engage a pair of a plurality of apertures 60 formed within the outer tube 58, thereby locking the inner tube 57 within the outer tube 58 in one of a plurality of positions as shown in phantom in FIG. 4. The second substantially vertical portion 52 may be of identical telescoping construction as portion 44.

The support bar 32 extends between the first and second arms 28 and 30 proximate the cantilever ends 36 and 40. The support bar 32 includes a substantially horizontal mounting member 61 and first and second substantially vertical connecting members 62 and 64. A plurality of mounting points are defined by mounting tubes 66 fixed to the mounting member 61.

The first and second arms 28 and 30 are rotatably mounted to the support bar 32 by first and second cantilever sleeve assemblies 68 and 70, respectively. The sleeve assemblies 68 and 70 permit 360° independent rotational movement of the first and second arms 28 and 30 about the longitudinal axes 71 and 72 of the second substantially vertical portions 44 and 52.

Figure 5:
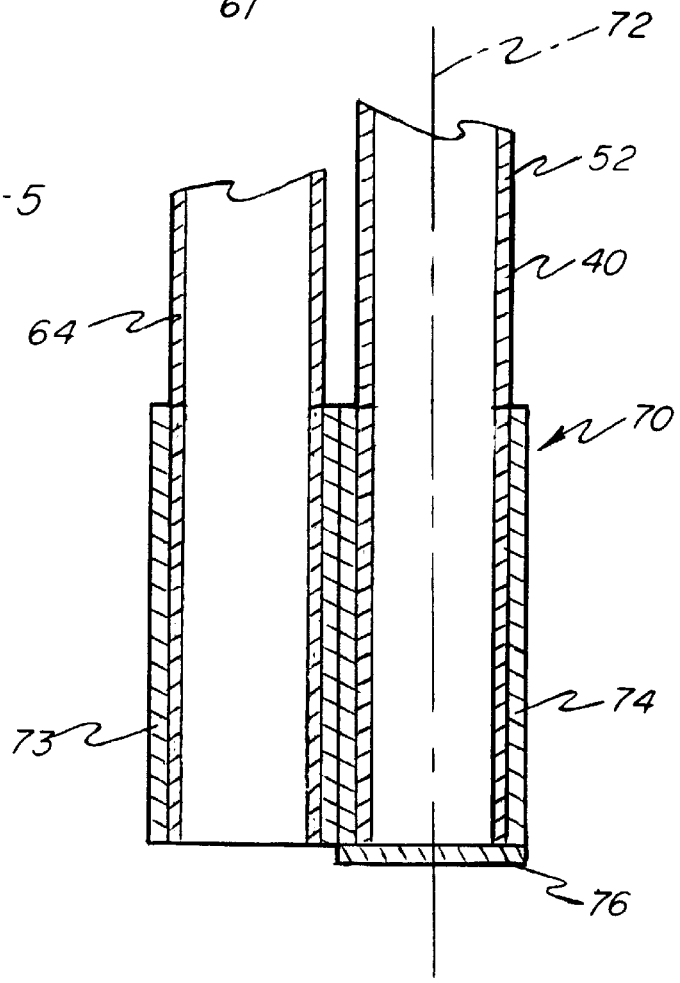
FIG. 5 is a cross-sectional view taken along line 5—5 of FIG. 2.

Referring to FIGS. 2 and 5, each cantilever sleeve assembly 68 and 70 has a first sleeve 73 fixed to one of the first and second connecting members 62 and 64 of the support bar 32. A second sleeve 74 of each sleeve assembly receives one of the cantilever ends 36 and 40 of the first and second arms 28 and 30 respectively. The outer diameter of the cantilever ends 36 and 40 is slightly less than the inner diameter of the corresponding second sleeve 74 thereby permitting relative rotational movement. An end cap 76 is fixed to the cantilever ends 36 and 40 of each arm 28 and 30 thereby preventing the sleeve assemblies 68 and 70 from sliding off of the arms 28 and 30. The relative rotational movement between the arms 28 and 30 and the support bar 32 facilitates the proper positioning of the apparatus adjacent the vertical wall 22 and assists in the alignment of the base ends 34 and 38 within the anchor sockets 56 and 58 of the pool deck 54.

A wall engaging structure is supported by the frame 26 for engaging an inner surface 78 of the vertical wall 22 thereby stabilizing the apparatus 10 a fixed distance from the wall 22. As seen in FIGS. 1 and 3, the wall engaging structure preferably comprises a plurality of stop arms 80 in spaced relation to each other and fixed to the support bar 32. The stop arms 80 extend in a rearward direction toward the vertical wall 22. Each stop arm 80 includes a wall engaging end 82 having a resilient stop member 84 fixed thereon. Preferably, the resilient stop members 84 are made of a rubber material which protects the inner surface 78 of the vertical wall 22 from damaging contact with the apparatus 10.

Figure 6:
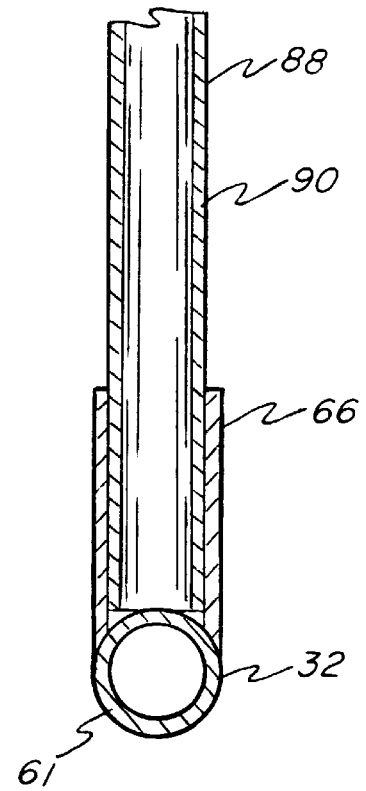
FIG. 6 is a cross-sectional view taken along line 6—6 of FIG. 2.

In the preferred embodiment as illustrated in FIGS. 1–3, a plurality of swimming pool accessories 12 are shown detachably mounted to the support bar 32. Referring further to FIG. 6, each accessory 12 includes an attachment tube 88 having an outside diameter slightly greater than an inside diameter of the mounting tubes 66 of the support bar 32. Each of the attachment tubes 88 is received within one of the mounting tubes 66, causing frictional engagement therebetween. The accessories 12 may be easily removed and replaced with different accessories by simply pulling the attachment tubes 88 from their respective mounting tubes 66.

Figure 7:
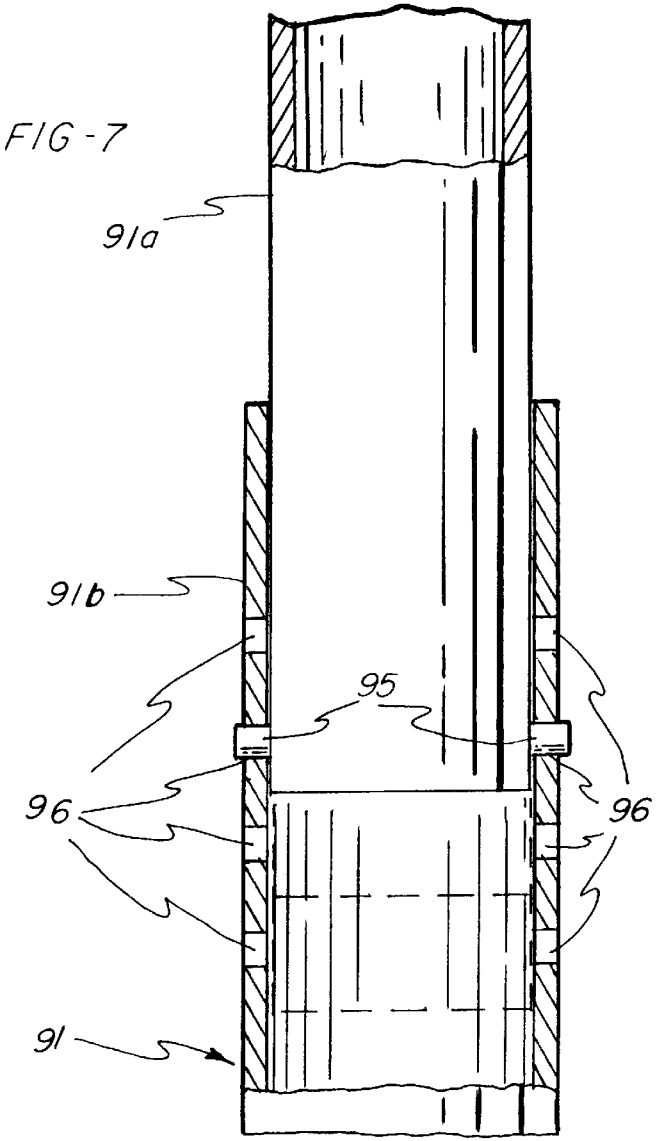
FIG. 7 is a partial cross-sectional view of an alternative embodiment of the attachment tube of the present invention.

Referring again to FIGS. 1–3, in order to support each accessory 12*a* proper distance from the vertical wall 22, each attachment tube 88 includes first and second substantially vertical members 90 and 91 connected by a substantially horizontal member 92. It may also be appreciated that such a design facilitates adjustment of an accessory 12 by pivoting its attachment tube 88 about the longitudinal axis 93 of the first member 90 as indicated by arrow 94 (FIG. 1). Referring further to FIG. 7, the second substantially vertical members 91 may each include an inner tube 91*a* received within an outer tube 91*b* in a telescoping relationship for adjusting the vertical position of the accessories 12. The inner tube 91*a* may include a pair of spring biased pins 95 adapted to engage a pair of a plurality of apertures 96 formed within the outer tube 91*b*, thereby locking the inner tube 91*a* within the outer tube 91*b* in one of a plurality of positions as shown in phantom in FIG. 7.

It is preferred that the first and second arms 28 and 30, support bar 32, cantilever sleeve assemblies 68 and 70 and attachment tubes 88 all be made from stainless steel tubing to protect the apparatus from the harsh conditions associated with swimming pools. Of course, other materials could be substituted therefor including polyvinyl chloride (PVC) tubing.

The accessories 12 may include chairs, tables, umbrellas, baby seats or toys, but are not limited thereto. More particularly, it is envisioned that the accessories 12 may be of the type specially adapted for use by handicapped or paraplegic individuals. It should be further noted that while FIGS. 1–3 illustrate five accessories arranged in the order of two pairs of chairs 97 separated by a table 98, this particular combination is for illustrative purposes only and in no way limits the scope of the present invention. Any number or variety of accessories may be arranged in an unlimited number of combinations upon the apparatus of the present invention.

Figure 8:
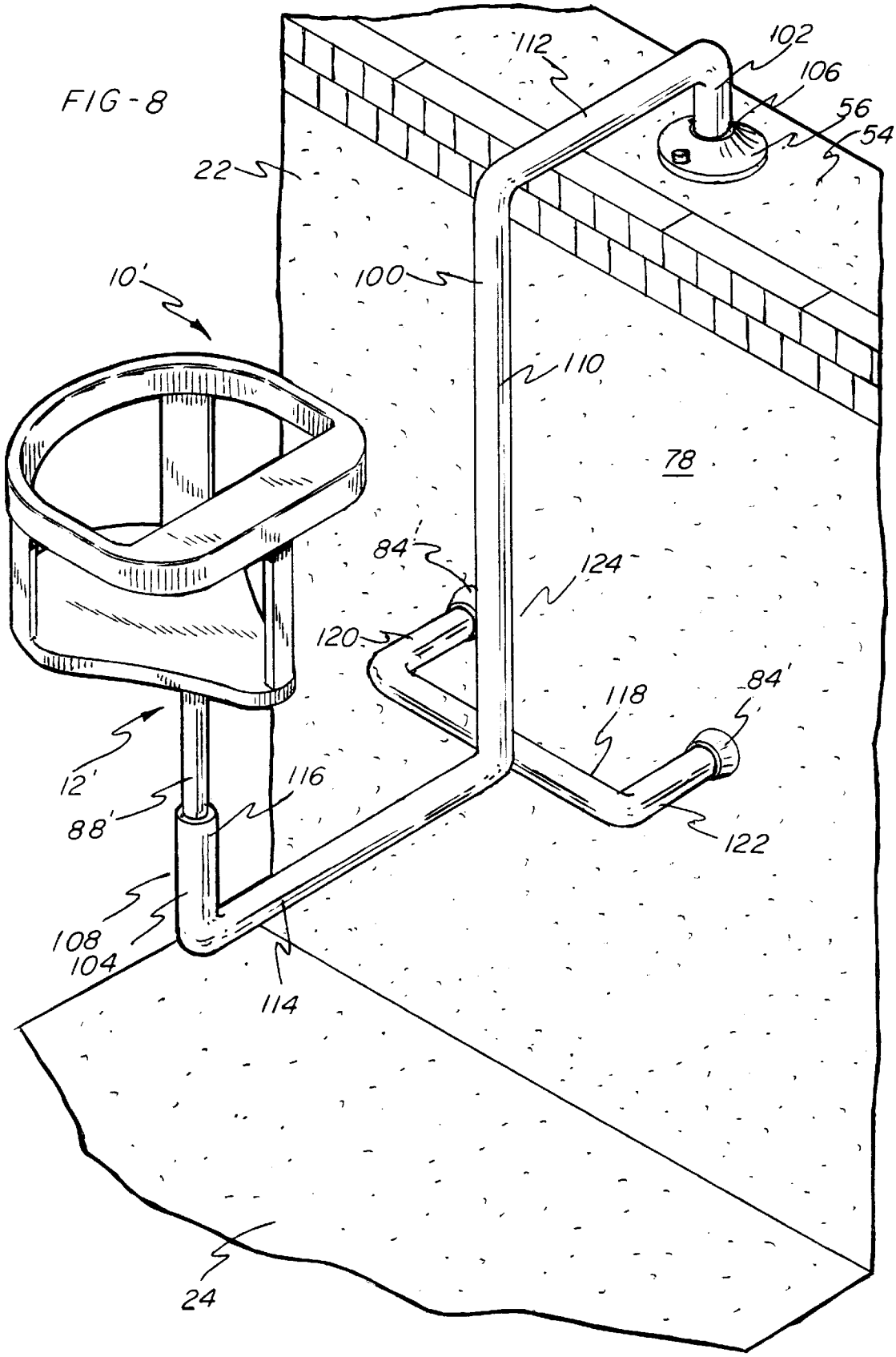
FIG. 8 is a perspective view of an alternative embodiment of the present invention supported by a vertical wall defining a swimming pool.

An alternative embodiment of the apparatus 10 of the present invention is shown in FIG. 8. The apparatus 10' is adapted to support a single accessory 12' adjacent a vertical wall 22 defining a swimming pool 24. An arm 100 comprising an S-shaped member includes first and second substantially vertical outer portions 102 and 104 defining a base end 106 and a cantilever end 108 respectively. The outer portions 102 and 104 are connected to a substantially vertical inner portion 110 by first and second substantially horizontal connecting portions 112 and 114. The base end 106 is secured to an anchor socket 56 formed within a deck 54 located outside the swimming pool 24 in a manner as is well known in the art.

The S-shaped structure of the arm 100 permits it to straddle the vertical wall 22 wherein the cantilever end 108 is supported inside the swimming pool 24 a fixed distance from an inner surface 78 of the wall 22. The combined length of the first and second outer portions 102 and 104 is significantly less than the length of the inner portion 110 whereby the cantilever end 108 is supported below the base end 106. The arm 100 is dimensioned such that the cantilever end 108 is submerged in water. The inner portion 110 may be of the structure illustrated in FIG. 4 and include an inner tube 57 received within an outer tube 58 in a telescoping relationship for adjusting the vertical position of the cantilever end 108. The inner tube 57 may include a pair of spring biased pins 59 adapted to engage a pair of a plurality of apertures 60 formed within the outer tube 58, thereby locking the inner tube 57 within the outer tube 58 in one of a plurality of positions as shown in phantom in FIG. 4.

A mounting point, preferably a mounting tube 116, is defined by the cantilever end 108 of the arm 100. A wall engaging structure 118 comprising a U-shaped member is fixed to a lower end of the inner portion 110 of the arm 100. The U-shaped member includes first and second stop arms 120 and 122 defining an open end 124 and extending in a rearward direction toward the vertical wall 22. Resilient stop members 84' are fixed to the first and second stop arms 120 and 122 adjacent the open end 124. The resilient stop members 84' are preferably made of a rubber material which serves to protect the inner surface 78 of the wall 22 from damaging contact with the wall engaging structure 118.

The accessory 12' is of similar design as accessory 12 described above. More particularly, the accessory 12' is adapted to be detachably mounted within the mounting tube 116 of the arm 100 as shown in FIG. 5. The accessory 12' includes an attachment tube 88' having an outside diameter slightly greater than the inside diameter of the mounting tube 116. The attachment tube 88' is received within the mounting tube 116, causing frictional engagement therebetween.

It is preferred that the arm 100, wall engaging structure 118 and attachment tube 88' be made of stainless steel tubing. Of course, other materials may be substituted therefor including, but not limited to, polyvinyl chloride (PVC) tubing.

As illustrated in FIG. 6, the accessory 12' may comprise a baby seat. However, it should be noted that a baby seat is shown for illustrative purposes only and that the accessory may be any swimming pool accessory including but not limited to a chair, table, toy or umbrella.

While the foregoing discussion has described the apparatus 10 and 10' as attached to a vertical wall 22 defining a swimming pool 24, it is readily apparent that the present invention may be similarly supported about any vertical wall defining an aquatic body, such as a spa or hot tub.

It should be apparent from the above description that the present apparatus is adapted to suspend an accessory adjacent a vertical wall defining an aquatic body. The apparatus includes arms having adjustable base ends which may be conveniently placed in anchor sockets formed in the deck outside the aquatic body. Finally, the apparatus detachably mounts an accessory such that the accessory may be interchanged with a different accessory as the user desires, thereby allowing the apparatus to be customized for his or her use.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An apparatus suspending a detachable accessory, said apparatus comprising:

a first arm for positioning adjacent a vertical wall defining an aquatic body, said first arm having a base end and a cantilever end supported below said base end;

a second arm for positioning adjacent a vertical wall defining an aquatic body, said second arm located in spaced relation to said first arm and having a base end and a cantilever end supported below said base end;

a support bar extending between said first and second arms proximate said cantilever ends, wherein said first and second arms and said support bar define a frame;

a plurality of mounting points integral with said frame;

a wall engaging structure supported by said frame for engaging an inner surface of a vertical wall;

a first detachably mounted accessory releasably engaging a first one of said mounting points; and a second detachably mounted accessory interchangeable with said first detachably mounted accessory for releasably engaging said first one of said mounting points.

2. The apparatus as recited in claim 1 wherein said wall engaging structure comprises at least one resilient stop member.

3. The apparatus as recited in claim 1 wherein said first and second arms each comprise U-shaped members having first and second substantially vertical portions connected by a substantially horizontal portion.

4. The apparatus as recited in claim 3 wherein said second substantially vertical portion defines said cantilever end of each said arm and comprises an inner tube received within an outer tube in a telescoping relationship for adjusting said cantilever end relative said base end.

5. The apparatus as recited in claim 1 wherein said first and second arms are rotatably mounted to said support bar.

6. The apparatus as recited in claim 1 wherein each said accessory includes an attachment tube for releasably engaging said at least one mounting point of said support bar.

7. The apparatus as recited in claim 6 wherein each said mounting point is defined by a mounting tube for receiving said attachment tube of said accessory.

8. The apparatus as recited in claim 7 wherein said attachment tube of each said accessory is adapted to frictionally engage said mounting tube of said support bar.

9. The apparatus as recited in claim 6 wherein said attachment tube of each said accessory includes first and second substantially vertical members connected by a substantially horizontal member.

10. The apparatus as recited in claim 9 wherein said second substantially vertical member comprises an inner tube received within an outer tube in a telescoping relationship for adjusting a vertical position of said accessory.

11. The apparatus as recited in claim 1 wherein said first detachably mounted accessory comprises a chair and said second detachably mounted accessory comprises a table.

12. The apparatus as recited in claim 1 wherein said first detachably mounted accessory comprises a baby seat.

13. An apparatus suspending a plurality of detachable accessories, said apparatus comprising:

a first arm for positioning adjacent a vertical wall defining a swimming pool and having a base end and a cantilever end, said first arm comprising a U-shaped member having first and second substantially vertical portions connected by a substantially horizontal portion, wherein said base end is adapted to be attached to a surface defining a deck outside a swimming pool and said cantilever end is adapted to be supported inside a swimming pool below said base end;

a second arm for positioning adjacent a vertical wall in spaced relation to said first arm and having a base end and a cantilever end, said second arm comprising a U-shaped member having first and second substantially vertical portions connected by a substantially horizontal portion, wherein said base end is adapted to be attached to a surface defining a deck outside a swimming pool and said cantilever end is adapted to be supported inside a swimming pool below said base end;

a support bar extending between and rotatably mounted to said first and second arms proximate said cantilever ends, said support bar including a plurality of mounting tubes intermediate said first and second arm;

a wall engaging structure including a plurality of stop arms fixed to said support bar for engaging an inside surface of a vertical wall, wherein each of said plurality of stop arms includes a wall engaging end having a resilient stop member fixed thereto; and a plurality of swimming pool accessories, wherein each said accessory includes an attachment tube for detachably engaging one of said mounting tubes of said support bar, said attachment tube of each said accessory selectively and interchangeably engageable with said plurality of mounting tubes.

14. An apparatus suspending a plurality of accessories, said apparatus comprising:

a frame including a first arm for positioning adjacent a vertical wall defining an aquatic body, a second arm for positioning adjacent a vertical wall defining an aquatic body, said second arm located in spaced relation to said first arm, and a support bar extending between said first and second arms;

wherein said first and second arms each include a base end and an opposing cantilever end positioned below said base end;

a plurality of mounting points integral with said frame; and a plurality of detachably mounted accessories selectively and releasably engaging said plurality of mounting points, each of said accessories interchangeably engageable with said plurality of mounting points.

15. The apparatus as recited in claim 14 wherein said plurality of detachably mounted accessories include at least one chair and at least one table.

16. The apparatus as recited in claim 14 wherein each of said plurality of accessories includes an attachment tube for releasably engaging one of said plurality of mounting points.

17. The apparatus as recited in claim 16 wherein each of said plurality of mounting points is defined by a mounting tube for selectively receiving said attachment tube of each of said plurality of accessories.

* * * * *